US009601077B2

(12) United States Patent
Lim et al.

(10) Patent No.: US 9,601,077 B2
(45) Date of Patent: Mar. 21, 2017

(54) CIRCUIT FOR COMPENSATING A RIPPLE, METHOD OF DRIVING DISPLAY PANEL USING THE CIRCUIT AND DISPLAY APPARATUS HAVING THE CIRCUIT

(71) Applicant: Samsung Display Co., LTD., Yongin, Gyeonggi-Do (KR)

(72) Inventors: Woon-Yong Lim, Busan (KR); Tong-Ill Kwak, Cheonan-si (KR); Min-Ho Park, Asan-si (KR); Yong-Jin Shin, Asan-si (KR); Tae-Gwang Jung, Seongnam-si (KR); Bong-Kyun Jo, Hwaseong-si (KR); Ki-Hyun Pyun, Goyang-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 282 days.

(21) Appl. No.: 14/165,942

(22) Filed: Jan. 28, 2014

(65) Prior Publication Data

US 2015/0054809 A1 Feb. 26, 2015

(30) Foreign Application Priority Data

Aug. 23, 2013 (KR) ..... 10-2013-0100349

(51) Int. Cl.
*G09G 5/00* (2006.01)
*G09G 3/36* (2006.01)

(52) U.S. Cl.
CPC ..... *G09G 3/3696* (2013.01); *G09G 3/3655* (2013.01); *G09G 3/3648* (2013.01)

(58) Field of Classification Search
CPC .. G09G 3/3648; G09G 3/3655; G09G 3/3696; G05F 3/02
USPC ..... 345/87–98, 174, 204–214, 690; 323/271, 323/282; 315/85; 361/782; 363/20, 363/21.01
See application file for complete search history.

(56) References Cited

U.S. PATENT DOCUMENTS 4,514,701 A * 4/1985 Machida ..... H03G 3/3005 330/137
5,584,068 A * 12/1996 Mohindra ..... H04B 1/30 375/344
5,940,170 A * 8/1999 Berg ..... G01B 11/00 356/141.4
6,115,114 A * 9/2000 Berg ..... G01B 11/00 177/25.15

(Continued)

FOREIGN PATENT DOCUMENTS

CN 20178037 * 6/2011
JP 2006087064 B2 3/2006

(Continued)

*Primary Examiner* — Prabodh M Dharia
(74) *Attorney, Agent, or Firm* — Cantor Colburn LLP

(57) ABSTRACT

A circuit includes a reference signal generating part configured to generate a plurality of reference signals having levels different from each other, a comparing part configured to compare a ripple signal with the reference signals to determine a level of the ripple signal, a compensating signal generating part configured to generate a compensation ripple signal corresponding to the level of the ripple signal, where the compensation ripple signal has a phase opposite to the ripple signal, and a push-pull circuit configured to stabilize the compensation ripple signal.

13 Claims, 5 Drawing Sheets

(56) References Cited

U.S. PATENT DOCUMENTS 6,288,496 B1 * 9/2001 Suzuki ..... G09G 3/3216 315/169.1
6,456,050 B1 * 9/2002 Agiman ..... H02M 3/1563 323/282
8,817,011 B2 * 8/2014 Satani ..... G09G 3/3688 345/212
2003/0137286 A1 * 7/2003 Kimball ..... H02M 3/1584 323/271
2004/0100239 A1 * 5/2004 Klotz ..... H02M 1/15 323/282
2005/0253836 A1 * 11/2005 Kim ..... G02F 1/136286 345/212
2006/0050042 A1 * 3/2006 Yi ..... G09G 3/3696 345/98
2006/0244704 A1 * 11/2006 JaeHun ..... G09G 3/3655 345/92
2007/0252622 A1 * 11/2007 Saenz ..... H03K 5/086 327/72
2007/0291042 A1 * 12/2007 Kwak ..... G02F 1/1345 345/535
2009/0116264 A1 * 5/2009 Lin ..... H02M 3/33561 363/20
2009/0219307 A1 * 9/2009 Yaguma ..... G09G 3/3655 345/690
2010/0019749 A1 * 1/2010 Katsuya ..... H02M 1/15 323/282
2010/0026676 A1 * 2/2010 Liu ..... G09G 3/20 345/212
2010/0033514 A1 * 2/2010 Park ..... G09G 3/2011 345/690
2010/0060558 A1 * 3/2010 Kim ..... G09G 3/3655 345/87
2010/0110058 A1 * 5/2010 Moh ..... G09G 3/3655 345/211
2010/0194728 A1 * 8/2010 Shingai ..... G09G 3/3622 345/208
2010/0254108 A1 * 10/2010 Kim ..... G09G 3/3696 361/782
2010/0277399 A1 * 11/2010 Yu ..... G09G 3/3655 345/58
2012/0062544 A1 * 3/2012 Satani ..... G09G 3/3688 345/212
2012/0162184 A1 * 6/2012 Kim ..... G09G 3/3655 345/212
2012/0256870 A1 * 10/2012 Klein ..... G06F 3/044 345/174
2013/0051090 A1 2/2013 Xie et al.
2013/0119867 A1 * 5/2013 Yu ..... H05B 33/0815 315/120
2013/0141316 A1 * 6/2013 Lee ..... G09G 3/3266 345/76
2013/0314606 A1 * 11/2013 Murakami ..... H04N 5/63 348/730
2013/0328750 A1 * 12/2013 Moh ..... G09G 3/3655 345/58
2013/0343095 A1 * 12/2013 Zhu ..... H02M 1/4258 363/21.01
2014/0015741 A1 * 1/2014 Wang ..... G09G 3/3611 345/88
2014/0111496 A1 * 4/2014 Gomez ..... G09G 3/3696 345/212
2014/0300274 A1 * 10/2014 Acatrinei ..... H05B 33/0815 315/85
2014/0371931 A1 * 12/2014 Lin ..... H02S 10/00 700/287
2015/0022543 A1 * 1/2015 Nelson ..... B60R 1/088 345/589
2015/0154917 A1 * 6/2015 Jung ..... G09G 3/342 345/102
2016/0012778 A1 * 1/2016 Kim ..... G09G 3/3233 345/79

FOREIGN PATENT DOCUMENTS

JP 2013038603 A 2/2013
KR 1020040008819 A 1/2004
KR 1020050122099 A 12/2005
KR 1020060022458 A 3/2006

* cited by examiner

CIRCUIT FOR COMPENSATING A RIPPLE, METHOD OF DRIVING DISPLAY PANEL USING THE CIRCUIT AND DISPLAY APPARATUS HAVING THE CIRCUIT

This application claims priority to Korean Patent Application No. 10-2013-0100349, filed on Aug. 23, 2013, and all the benefits accruing therefrom under 35 U.S.C. §119, the content of which in its entirety is herein incorporated by reference.

BACKGROUND

1. Field

Exemplary embodiments of the invention relate to a circuit for compensating a ripple, a method of driving a display panel using the circuit and a display apparatus including the circuit. More particularly, exemplary embodiments of the invention relate to a circuit for compensating a ripple with improved display quality, a method of driving a display panel using the circuit and a display apparatus including the circuit.

2. Description of the Related Art

Generally, a liquid crystal display ("LCD") apparatus has relatively thin thickness, light weight and low power consumption, and thus the LCD apparatus is widely used in monitors, laptop computers and cellular phones, etc. The LCD apparatus includes an LCD panel that displays images using a light transmittance of a liquid crystal, a backlight assembly that is disposed under the LCD panel and provides light to the LCD panel and a driving circuit that drives the LCD panel.

The liquid display panel typically includes an array substrate, which includes a gate line, a data line, a thin film transistor and a pixel electrode, and an opposing substrate, which includes a common electrode, and a liquid crystal layer, which disposes between the array substrate and opposing substrate. A pixel of the LCD panel typically includes a liquid crystal capacitor and a storage capacitor. The liquid crystal capacitor typically includes a pixel electrode, a liquid crystal layer and a common electrode. The storage capacitor typically includes the pixel electrode and a storage electrode overlapping the pixel electrode. The liquid crystal capacitor charges a data voltage to display a grayscale. The storage capacitor maintains the data voltage charged in the liquid crystal capacitor during a frame period.

The storage electrode receives a common voltage. The common voltage typically includes a ripple signal by a pattern image displayed on the LCD panel and physical characteristics of the LCD panel.

SUMMARY

In an LCD apparatus, as described above, a crosstalk between pattern images displayed thereon the LCD panel may occur by the ripple signal of a common voltage such that display quality of the LCD panel may be decreased.

Exemplary embodiments of the invention provide a circuit that compensates the ripple included in the common voltage.

Exemplary embodiments of the invention provide a method of driving a display panel using the circuit.

Exemplary embodiments of the invention provide a display apparatus including the circuit.

According to an exemplary embodiment of the invention, a circuit for compensating a ripple includes a reference signal generating part configured to generate a plurality of reference signals having levels different from each other, a comparing part configured to compare a ripple signal with the reference signals to determine a level of the ripple signal, a compensating signal generating part configured to generate a compensation ripple signal corresponding to the level of the ripple signal, where the compensation ripple signal has a phase opposite to the ripple signal, and a push-pull circuit configured to stabilize the compensation ripple signal.

In an exemplary embodiment, the comparing part may include a plurality of comparators, where each of the comparators compares two reference signals among the reference signals with the ripple signal, and determines whether the level of the ripple signal is between levels of the two reference signals.

In an exemplary embodiment, the compensating signal generating part may include a plurality of amplifiers, where the amplifiers receives output signals of the comparators, respectively, and the amplifiers have gain values different from each other.

In an exemplary embodiment, the compensating signal generating part may generate the compensation ripple signal through an amplifier having a gain value corresponding to the level of the ripple signal among the amplifiers.

According to an exemplary embodiment of the invention, a method of driving a display panel includes determining a level of a ripple signal which is received from the display panel, generating a compensation ripple signal corresponding to the level of the ripple signal, where the compensation ripple signal has a phase opposite to the ripple signal, and providing the display panel with the compensation ripple signal.

In an exemplary embodiment, the determining the level of the ripple signal may include comparing a plurality of reference signals with the ripple signal, and determining whether the level of the ripple signal is between levels of the reference signals.

In an exemplary embodiment, the generating the compensation ripple signal includes generating the compensation ripple signal through an amplifier having a gain value corresponding to the level of the ripple signal among a plurality of amplifiers which has gain values different from each other.

In an exemplary embodiment, when the level of the ripple signal is low, the compensation ripple signal may be generated through an amplifier having a low gain value among the amplifiers, and when the level of the ripple signal is high, the compensation ripple signal may be generated through an amplifier having a high gain value among the amplifiers.

In an exemplary embodiment, the compensation ripple signal may be stabilized through a push-pull circuit.

In an exemplary embodiment, the display panel may include a thin film transistor connected to a data line and a gate line, a liquid crystal capacitor connected to the thin film transistor, and a storage capacitor connected to the liquid crystal capacitor and a common line, where the ripple signal may be received from a common voltage terminal which is connected to the common line.

In an exemplary embodiment, the compensation ripple signal may be loaded into the common voltage to be applied to the common voltage terminal.

According to an exemplary embodiment of the invention, a display apparatus includes a display panel including a thin film transistor connected to a data line and a gate line, a liquid crystal capacitor connected to the thin film transistor and a storage capacitor connected to the liquid crystal capacitor and a common line, a voltage generating part configured to generate a common voltage which is applied to the common line, and a ripple compensation part configured to determine a level of a ripple signal which is received from the display panel and to generate a compensation ripple signal corresponding to the level of the ripple signal, where the compensation ripple signal has a phase opposite to the ripple signal.

In an exemplary embodiment, the ripple compensation part may include a reference signal generating part configured to generate a plurality of reference signals having levels different from each other, a comparing part configured to compare the ripple signal with the reference signals to determine the level of the ripple signal, and a compensating signal generating part configured to generate the compensation ripple signal corresponding to the level of the ripple signal.

In an exemplary embodiment, the comparing part may include a plurality of comparators, where each of the comparators may compare two reference signals among the reference signals with the ripple signal and determine whether the level of the ripple signal is between levels of the two reference signals.

In an exemplary embodiment, the compensating signal generating part may include a plurality of amplifiers, where the amplifiers may receive output signals of the comparators, respectively, and the amplifiers have gain values different from different from each other.

In an exemplary embodiment, the compensating signal generating part may generate the compensation ripple signal through an amplifier having a gain value corresponding to the level of the ripple signal among the amplifiers.

In an exemplary embodiment, when the level of the ripple signal is low, the compensating signal generating part may generate the compensation ripple signal through an amplifier having a low gain value among the amplifiers, and when the level of the ripple signal is high, the compensating signal generating part may generate the compensation ripple signal through an amplifier having a high gain value among the amplifiers.

In an exemplary embodiment, the ripple compensation part may further include a push-pull circuit configured to stabilize the compensation ripple signal outputted from the compensating signal generating part.

In an exemplary embodiment, the display panel may further include a common voltage terminal connected to the common line, where the ripple signal may be received from a common voltage terminal.

In an exemplary embodiment, the voltage generating part may load the compensation ripple signal into the common voltage to be applied to the common voltage terminal.

According to exemplary embodiments of the invention, the compensation ripple signal may be generated by the amplifier having the gain value corresponding to the level of the ripple signal such that the ripple signal may be effectively removed, and the display quality may be thereby improved.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
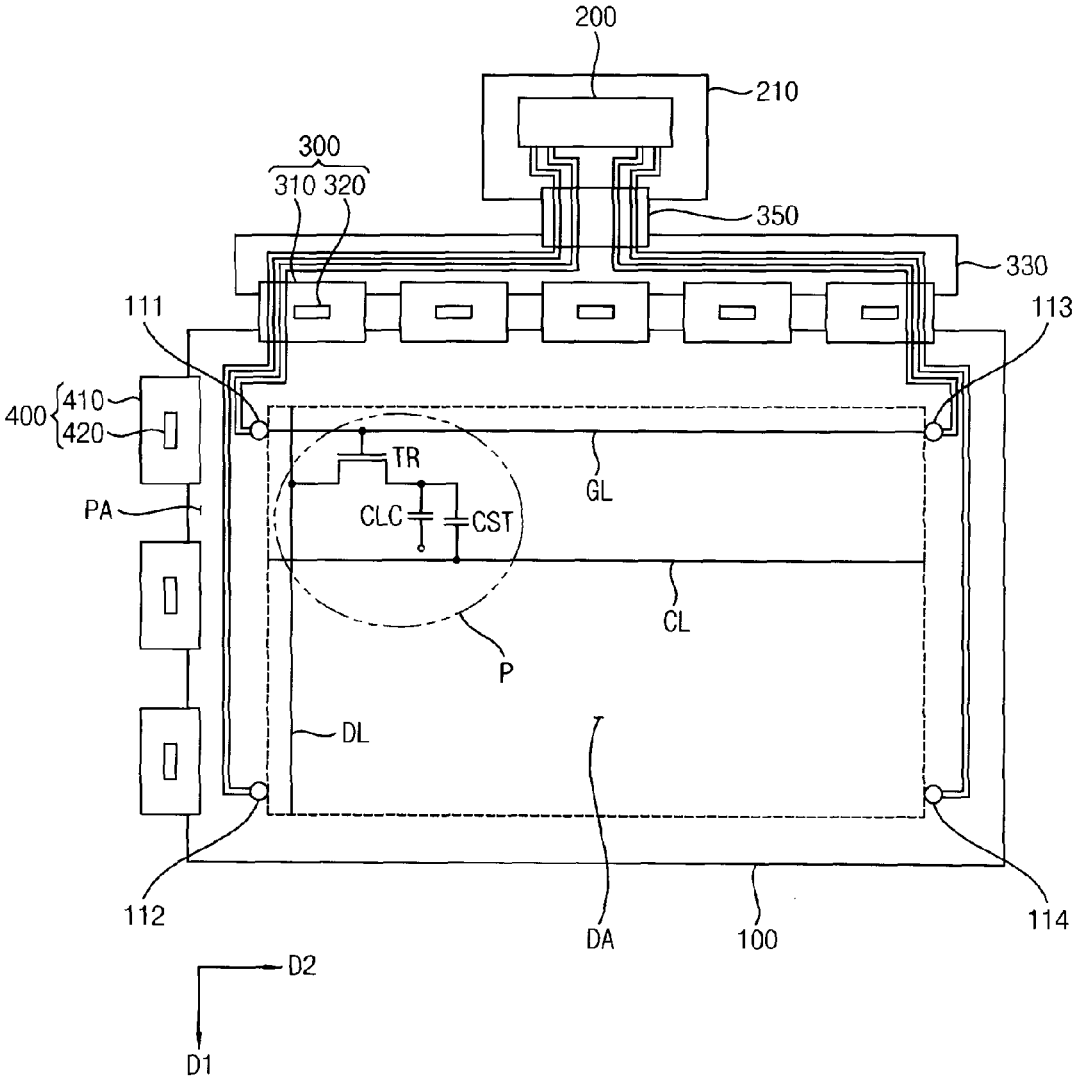
FIG. 1 is a block diagram illustrating an exemplary embodiment of a display apparatus, according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a block diagram illustrating an exemplary embodiment of a display apparatus, according to the invention.

Referring to FIG. 1, an exemplary embodiment of the display apparatus may include a display panel 100 and a panel driving part that drives the display panel 100.

The display panel 100 may include a display area DA and a peripheral area PA surrounding at least a portion of the display area DA. In such an embodiment, a plurality of data lines DL, a plurality of gate lines GL, a plurality of common lines CL and a plurality of pixels P are disposed in the display area DA. The data lines DL extend substantially in a first direction D1 and are arranged substantially in a second direction D2 crossing the first direction D1. The gate lines GL extend substantially in the second direction D2 and are arranged substantially in the first direction D1. The common lines CL extend substantially in the second direction D2 and are arranged substantially in the first direction D1. The common lines CL may be connected to each other in the peripheral area PA, and transfer a common voltage. The pixels P are arranged substantially in a matrix form which includes a pixel column defined by pixels arranged in the first direction D1 and a pixel row defined by pixels arranged in the second direction D2. Each of the pixels P may include a thin film transistor TR, a liquid crystal capacitor CLC and a storage capacitor CST. The thin film transistor is connected to a data line DL and a gate line GL, and the liquid crystal capacitor CLC is connected to the thin film transistor TR and the storage capacitor CST. The storage capacitor CST is connected to the common line CL to receive the common voltage.

The panel driving part is disposed in the peripheral area PA. According to an exemplary embodiment, as shown in FIG. 1, a plurality of common voltage terminals, e.g., a first common voltage terminal 111, a second common voltage terminal 112, a third common voltage terminal 113 and a fourth common voltage terminal 114, are disposed in the peripheral area PA. The common voltage terminals 111, 112, 113 and 114 are connected to the common lines CL and receive the common voltage.

The panel driving part may include a main circuit part 200, a data driving part 300 and a gate driving part 400.

The main circuit part 200 is disposed on a printed circuit board 210. The main circuit part 200 controls operations of the data driving part 300, the gate driving part 400 and the display panel 100.

In one exemplary embodiment, for example, the main circuit part 200 outputs a data control signal and a data driving voltage to drive the data driving part 300. The data control signal may include a horizontal synchronization signal, a vertical synchronization signal or a load signal, for example. The main circuit part 200 receives image data and corrects the image data for improving a response time and compensating white using compensation algorithms. The main circuit part 200 provides the data driving part 300 with the corrected image data.

The main circuit part 200 outputs a gate control signal and a gate driving voltage to drive the gate driving part 400. The gate control signal may include a vertical start signal and at least one clock signal, for example.

In an exemplary embodiment, the main circuit part 200 provides the common voltage terminals 111, 112, 113 and 1114 with the common voltage. The common voltage includes a compensation ripple signal to compensate a ripple signal. The main circuit part 200 receives a ripple signal which is received from each of the common voltage terminals 111, 112, 113 and 114 and generates a compensation ripple signal based on the ripple signal to offset the ripple signal. The main circuit part 200 loads the common voltage with the compensation ripple signal and provides the common voltage terminals 111, 112, 113 and 114 with the common voltage including the compensation ripple signal. Thus, the ripple signal of the common voltage applied to each of areas, in which the common voltage terminals 111, 112, 113 and 114 are located, may be effectively removed.

The data driving part 300 may include a data flexible circuit board 310 and a data driving chip 320 which is disposed on the data flexible circuit board 310. The data driving part 300 is electrically connected to the main circuit part 200 through a source printed circuit board 330 and a flexible circuit board 350. The data driving part 300 converts the image data to a data voltage based on the data control signal received from the main circuit part 200 and outputs the data voltage to the data line DL.

The gate driving part 400 may include a gate flexible circuit board 410 and a gate driving chip 420 which is disposed on the gate flexible circuit board 410. The gate driving chip 420 receives the gate control signal from the main circuit part 200 through the data flexible circuit board 310. The gate driving part 400 generates a gate signal based on the gate control signal and outputs the gate signal to the gate line GL.

In an alternative exemplary embodiment, the gate driving part 400 may be disposed directly on the peripheral area PA of the display panel 100. In one exemplary embodiment, for example, the gate driving part 400 may be formed on the peripheral area PA via the process substantially the same as a process for providing the thin film transistor TR on the display area DA.

Figure 2:
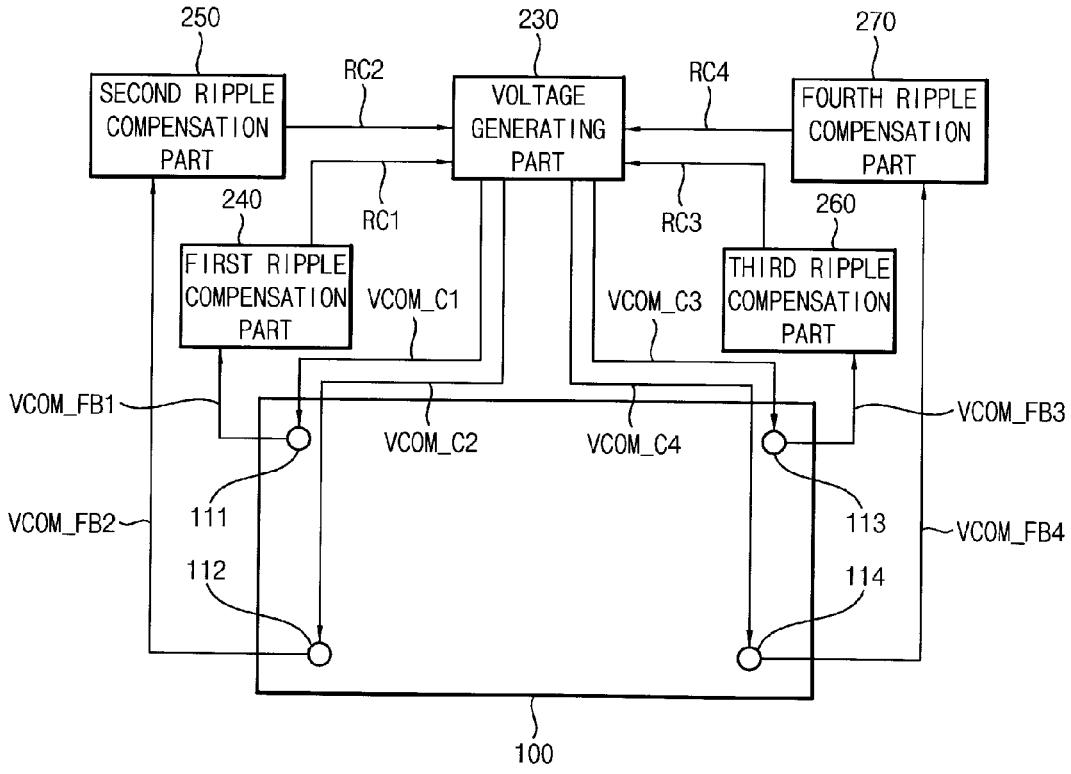
FIG. 2 is a block diagram illustrating an exemplary embodiment of a main circuit part shown in FIG. 1.

FIG. 2 is a block diagram illustrating an exemplary embodiment of a main circuit part shown in FIG. 1.

Referring to FIGS. 1 and 2, the main circuit part 200 may include a voltage generating part 230 and a plurality of ripple compensation parts 240, 250, 260 and 270.

In an exemplary embodiment, the voltage generating part 230 may generate the common voltage. The voltage generating part 230 loads a plurality of compensation ripple signals, e.g., a first compensation ripple signal RC1, a second compensation ripple signal RC2, a third compensation ripple signal RC3 and a fourth compensation ripple signal RC4, received from the ripple compensation parts 240, 250, 260 and 270 into the common voltage to generate a plurality of compensation common voltages, e.g., a first compensation common voltage VCOM_C1, a second compensation common voltage VCOM_C2, a third compensation common voltage VCOM_C3 and a fourth compensation common voltage VCOM_C4. The compensation common voltages VCOM_C1, VCOM_C2, VCOM_C3 and VCOM_C4 are applied to the common voltage terminals 111, 112, 113 and 114, respectively.

In one exemplary embodiment, for example, the first ripple compensation part 240 receives a first ripple signal VCOM_FB1 included in the common voltage from the first common voltage terminal 111, and generates the first compensation ripple signal RC1 having a phase opposite to the first ripple signal VCOM_FB1 through an inverting amplifier having a gain value corresponding to a level of the first ripple signal VCOM_FB1. The voltage generating part 230 loads the first compensation ripple signal RC1 into the common voltage and provides the first common voltage terminal 111 with the common voltage including the first compensation ripple signal RC1. Thus, the first ripple signal VCOM_FB1 is offset by the first compensation ripple signal RC1.

In such an embodiment, the second ripple compensation part 250 receives a second ripple signal VCOM_FB2 included in the common voltage from the second common voltage terminal 112, and generates the second compensation ripple signal RC2 having a phase opposite to the second ripple signal VCOM_FB2 through an inverting amplifier having a gain value corresponding to a level of the second ripple signal VCOM_FB2. The voltage generating part 230 loads the second compensation ripple signal RC2 into the common voltage and provides the second common voltage terminal 112 with the common voltage including the second compensation ripple signal RC2. Thus, the second ripple signal VCOM_FB2 is offset by the second compensation ripple signal RC2.

In such an embodiment, the third ripple compensation part 260 receives a third ripple signal VCOM_FB3 included in the common voltage from the third common voltage terminal 113, and generates the third compensation ripple signal RC3 having a phase opposite to the third ripple signal VCOM_FB3 through an inverting amplifier having a gain value corresponding to a level of the third ripple signal VCOM_FB3. The voltage generating part 230 loads the third compensation ripple signal RC3 into the common voltage and provides the third common voltage terminal 113 with the common voltage including the third compensation ripple signal RC3. Thus, the third ripple signal VCOM_FB3 is offset by the third compensation ripple signal RC3.

In such an embodiment, the fourth ripple compensation part 270 receives a fourth ripple signal VCOM_FB4 included in the common voltage from the fourth common voltage terminal 114, and generates the fourth compensation ripple signal RC4 having a phase opposite to the fourth ripple signal VCOM_FB4 through an inverting amplifier having a gain value corresponding to a level of the fourth ripple signal VCOM_FB4. The voltage generating part 230 loads the fourth compensation ripple signal RC4 into the common voltage and provides the fourth common voltage terminal 114 with the common voltage including the fourth compensation ripple signal RC4. Thus, the fourth ripple signal VCOM_FB4 is offset by the fourth compensation ripple signal RC4.

In such an embodiment, the compensation ripple signal to be applied to a predetermined area of the display panel 100 is generated based on the level of the ripple signal detected at the predetermined area of the display panel 100 such that removal efficiency of the ripple signal may be improved. Therefore, a crosstalk between image patterns, which occurs by the ripple signal of the common voltage, may be effectively removed such that the display quality may be improved.

Figure 3:
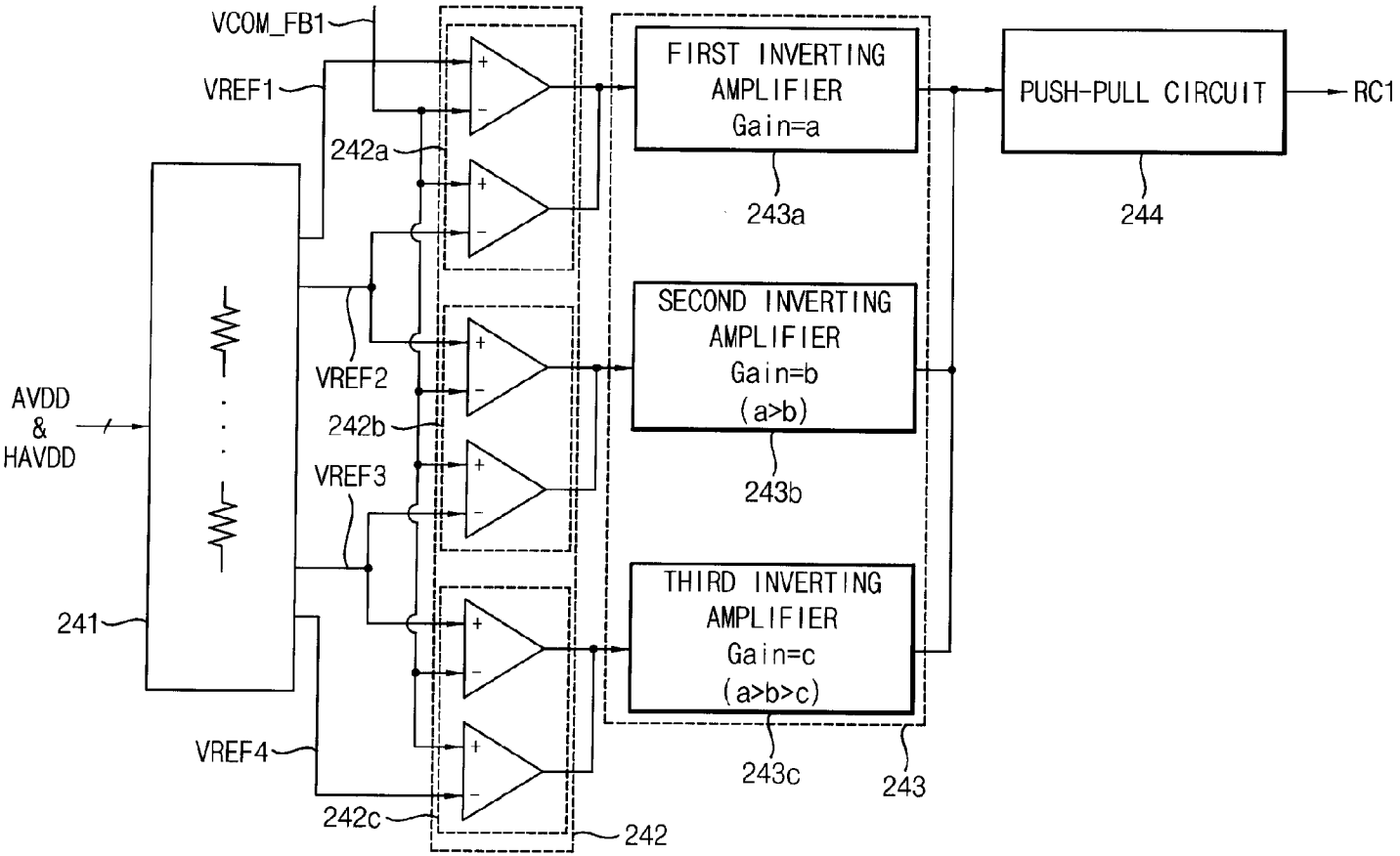
FIG. 3 is a block diagram illustrating an exemplary embodiment of a ripple compensation part shown in FIG. 2.
Figure 4:
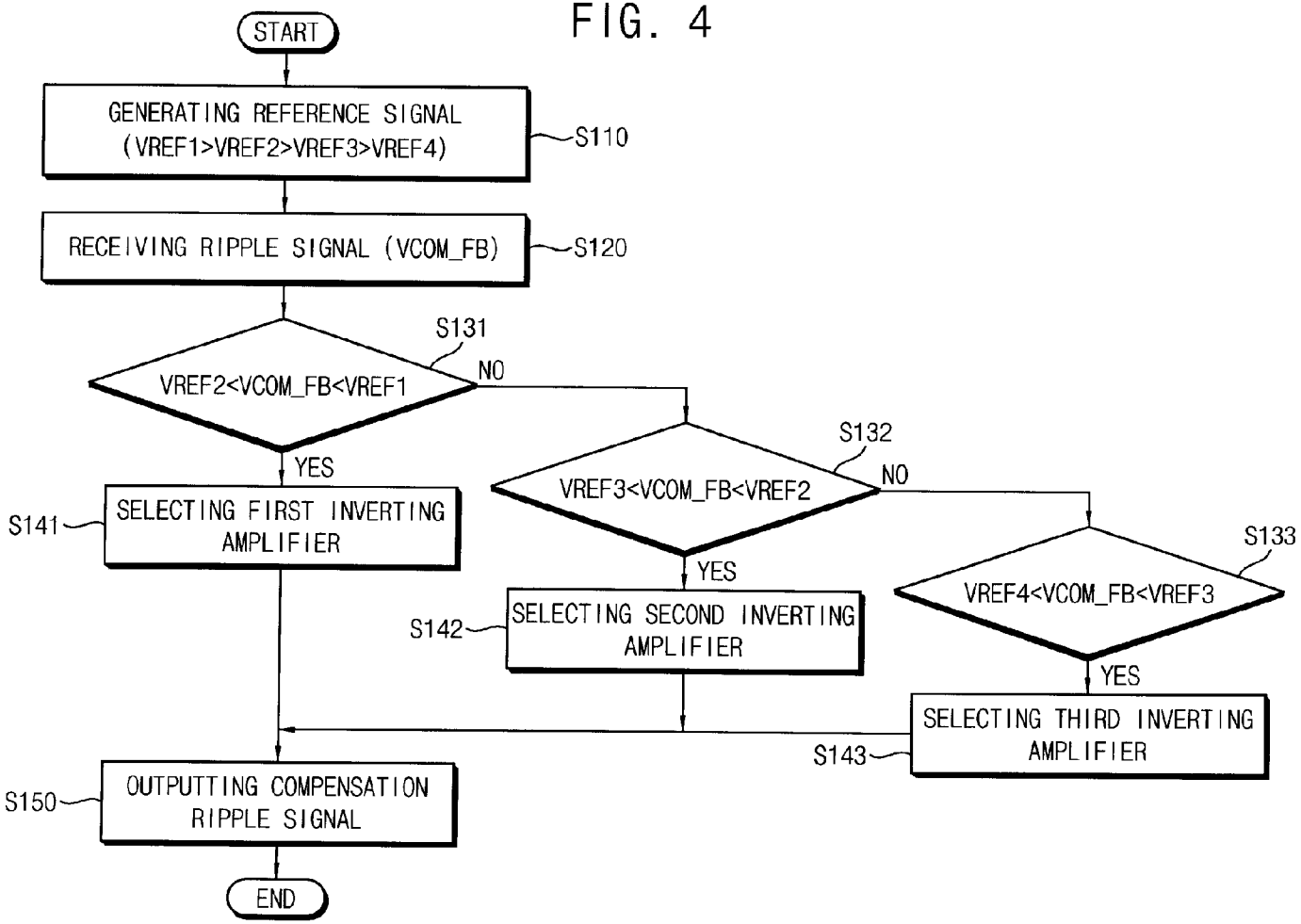
FIG. 4 is a flowchart illustrating an exemplary embodiment of a method of compensating a ripple of a common voltage applied to a display panel shown in FIG. 1.

FIG. 3 is a block diagram illustrating an exemplary embodiment of a ripple compensation part shown in FIG. 2. FIG. 4 is a flowchart illustrating an exemplary embodiment of a method of compensating a ripple of a common voltage applied to a display panel shown in FIG. 1. In an exemplary embodiment shown in FIG. 2, operations or structures of the ripple compensation parts 240, 250, 260 and 270 may be substantially the same as each other. Hereinafter, for convenience of description, an operation of the first ripple compensation part 240 will be described in greater detail, and will be referred to as the ripple compensation part.

Referring to FIGS. 3 and 4, the ripple compensation part 240 may include a reference signal generating part 241, a comparing part 242, a compensating signal generating part 243 and a push-pull circuit 244.

The reference signal generating part 241 generates a plurality of reference signals, e.g., a first reference signal VREF1, a second reference signal VREF2, a third reference signal VREF3 and a fourth reference signal VREF4, which have different levels from each other, using power source voltages AVDD and HAVDD (step S110). The reference signal generating part 241 may include a resistance string. The reference signals VREF1, VREF2, VREF3 and VREF4 may have levels that satisfy the following in equation: the first reference signal VREF1> the second reference signal VREF2> the third reference signal VREF3> the fourth reference signal VREF4.

In an exemplary embodiment, the comparing part 242 may include a plurality of comparators, e.g., a first comparator 242*a*, a second comparator 242*b* and a third comparator 242*c*, and receives a ripple signal VCOM_FB1 of the common voltage (step S120). The comparing part 242 compares the ripple signal VCOM_FB1 with the reference signals VREF1, VREF2, VREF3 and VREF4 to determine the level of the ripple signal VCOM_FB1.

The first comparator 242*a* compares the ripple signal VCOM_FB1 with the first and second reference signals VREF1 and VREF2 (step S131). When the level of the ripple signal VCOM_FB1 is between levels of the first reference signal VREF1 and the second reference signal VREF2, the first comparator 242*a* outputs the ripple signal VCOM_FB1.

The second comparator 242*b* compares the ripple signal VCOM_FB1 with the second and third reference signals VREF2 and VREF3 (step S132). When the level of the ripple signal VCOM_FB1 is between levels of the second reference signal VREF2 and the third reference signal VREF3, the second comparator 242*b* outputs the ripple signal VCOM_FB1.

The third comparator 242*c* compares the ripple signal VCOM_FB1 with the third and fourth reference signals VREF3 and VREF4 (step S133). When the level of the ripple signal VCOM_FB1 is between levels of the third reference signal VREF3 and the fourth reference signal VREF4, the third comparator 242*c* outputs the ripple signal VCOM_FB1.

The compensating signal generating part 243 may include a plurality of inverting amplifiers 243*a*, 243*b* and 243*c*. The compensating signal generating part 243 generates a compensation ripple signal RC1, which has a phase opposite to the ripple signal VCOM_FB1, through an inverting amplifier having a gain value corresponding to the level of the ripple signal VCOM_FB1.

In one exemplary embodiment, for example, the compensating signal generating part 243 may include a first inverting amplifier 243*a*, a second inverting amplifier 243*b* and a third inverting amplifier 243*c*. The first inverting amplifier 243*a* is connected to the first comparator 242*a*. The second inverting amplifier 243*b* is connected to the second comparator 242*b*. The third inverting amplifier 243*c* is connected to the third comparator 242*c*.

The first inverting amplifier 243*a* has a first gain value 'a'. When the level of the ripple signal VCOM_FB1 is between levels of the first reference signal VREF1 and the second reference signal VREF2, the first inverting amplifier 243*a* receives the ripple signal VCOM_FB1 outputted from the first comparator 242*a* (step S141). The first inverting amplifier 243*a* inverts a phase of the ripple signal VCOM_FB1 and amplifies the level of the ripple signal VCOM_FB1 by the first gain value 'a'. Thus, the first inverting amplifier 243*a* outputs the compensation ripple signal RC1 having the phase opposite to the ripple signal VCOM_FB1 (step S150).

The second inverting amplifier 243*b* has a second gain value 'b' that is less than the first gain value 'a'. When the level of the ripple signal VCOM_FB1 is between levels of the second reference signal VREF2 and the third reference signal VREF3, the second inverting amplifier 243*b* receives the ripple signal VCOM_FB1 outputted from the second comparator 242*b* (step S142). The second inverting amplifier 243*b* inverts the phase of the ripple signal VCOM_FB1 and amplifies the level of the ripple signal VCOM_FB1 by the second gain value 'b'. Thus, the second inverting amplifier 243*b* outputs the compensation ripple signal RC1 having the phase opposite to the ripple signal VCOM_FB1 (step S150).

The third inverting amplifier 243*c* has a third gain value 'c' that is less than the second gain value 'b'. When the level of the ripple signal VCOM_FB1 is between levels of the third reference signal VREF3 and the fourth reference signal VREF4, the third inverting amplifier 243*c* receives the ripple signal VCOM_FB1 outputted from the third comparator 242*c* (step S143). The third inverting amplifier 243*c* inverts the phase of the ripple signal VCOM_FB1 and amplifies the level of the ripple signal VCOM_FB1 by the third gain value 'c'. Thus, the third inverting amplifier 243*c* outputs the compensation ripple signal RC1 having the phase opposite to the ripple signal VCOM_FB1 (step S150).

The push-pull circuit 244 stabilizes and outputs the compensation ripple signal outputted from the compensating signal generating part 243.

The compensation ripple signal RC1 outputted from the push-pull circuit 244 is applied to the voltage generating part 230 which outputs the common voltage. Thus, the compensation common voltage VCOM_C1 including the compensation ripple signal RC1 is applied to the common voltage terminal 111 of the display panel 100 such that the ripple signal VCOM_FB1 is effectively offset by the compensation ripple signal RC1.

According to an exemplary embodiment, as described above, the level of the ripple signal received from the display panel 100 is determined and the compensation ripple signal is generated through the inverting amplifier having the gain value corresponding to the determined level of the ripple signal such that the removal efficiency of the ripple signal may be improved.

Hereinafter, an exemplary embodiment of a method of compensating the ripple signal, according to the invention, will be described referring to FIGS. 2, 3 and 4.

In an exemplary embodiment, the first ripple compensation part 240 receives the first ripple signal VCOM_FB1 which is received from the first common voltage terminal 111 of the display panel 100. The comparing part 242 compares the first ripple signal VCOM_FB1 and the reference signals VREF1, . . . , VREF4 to determine the level of the first ripple signal VCOM_FB1 (step S131 to step S133). In one exemplary embodiment, for example, when the first ripple signal VCOM_FB1 is between levels of the first and second reference signals VREF1 and VREF2 (step S131), the first inverting amplifier 243*a* which is connected to the first comparator 242*a* is selected (step S141). Thus, the first inverting amplifier 243*a* inverts and amplifies the level of the first ripple signal VCOM_FB1 by the first gain value 'a' to output the first compensation ripple signal RC1 (step S150). The first compensation ripple signal RC1 is stabilized through the push-pull circuit 244 to be applied to the voltage generating part 230. Then, the voltage generating part 230 provides the first common voltage terminal 111 of the display panel 100 with the first compensation common voltage VCOM_C1 including the first compensation ripple signal RC1.

The second ripple compensation part 250 receives the second ripple signal VCOM_FB2 which is received from the second common voltage terminal 112 of the display panel 100. The comparing part 242 compares the second ripple signal VCOM_FB2 and the reference signals VREF1, . . . , VREF4 to determine the level of the second ripple signal VCOM_FB2 (step S131 to step S133). In one exemplary embodiment, for example, when the second ripple signal VCOM_FB2 is between levels of the second and third reference signals VREF2 and VREF3 (step S132), the second inverting amplifier 243*b* which is connected to the second comparator 242*b* is selected (step S142). Thus, the second inverting amplifier 243*b* inverts and amplifies the level of the second ripple signal VCOM_FB2 by the second gain value 'b' to output the second compensation ripple signal RC2 (step S150). The second compensation ripple signal RC2 is stabilized through the push-pull circuit 244 to be applied to the voltage generating part 230. Then, the voltage generating part 230 provides the second common voltage terminal 112 of the display panel 100 with the second compensation common voltage VCOM_C2 including the second compensation ripple signal RC2.

The third ripple compensation part 260 receives the third ripple signal VCOM_FB3 which is received from the third common voltage terminal 113 of the display panel 100. The comparing part 242 compares the third ripple signal VCOM_FB3 and the reference signals VREF1, . . . , VREF4 to determine the level of the t third ripple signal VCOM_FB3 (step S131 to step S133). In one exemplary embodiment, for example, when the third ripple signal VCOM_FB3 is between levels of the second and third reference signals VREF2 and VREF3 (step S132), the second inverting amplifier 243*b* which is connected to the second comparator 242*b* is selected (step S142). Thus, the second inverting amplifier 243*b* inverts and amplifies the level of the third ripple signal VCOM_FB3 by the second gain value 'b' to output the third compensation ripple signal RC3 (step S150). The third compensation ripple signal RC3 is stabilized through the push-pull circuit 244 to be applied to the voltage generating part 230. Then, the voltage generating part 230 provides the third common voltage terminal 113 of the display panel 100 with the third compensation common voltage VCOM_C3 including the third compensation ripple signal RC3.

The fourth ripple compensation part 270 receives the fourth ripple signal VCOM_FB4 which is received from the fourth common voltage terminal 114 of the display panel 100. The comparing part 242 compares the fourth ripple signal VCOM_FB4 and the reference signals VREF1, . . . , VREF4 to determine the level of the fourth ripple signal VCOM_FB4 (step S131 to step S133). In one exemplary embodiment, for example, when the fourth ripple signal VCOM_FB4 is between levels of the third and fourth reference signals VREF3 and VREF4 (step S133), the third inverting amplifier 243*c* which is connected to the third comparator 242*c* is selected (step S143). Thus, the third inverting amplifier 243*c* inverts and amplifies the level of the fourth ripple signal VCOM_FB4 by the third gain value 'c' to output the fourth compensation ripple signal RC4 (step S150). The fourth compensation ripple signal RC4 is stabilized through the push-pull circuit 244 to be applied to the voltage generating part 230. Then, the voltage generating part 230 provides the fourth common voltage terminal 114 of the display panel 100 with the fourth compensation common voltage VCOM_C4 including the fourth compensation ripple signal RC4.

As described above, according to an exemplary embodiment, the compensation ripple signal corresponding to the ripple signal, which is received from an area of the display panel 100, is applied to the area of the display panel 100 such that the removal efficiency of the ripple signal may be improved.

Figure 5A:
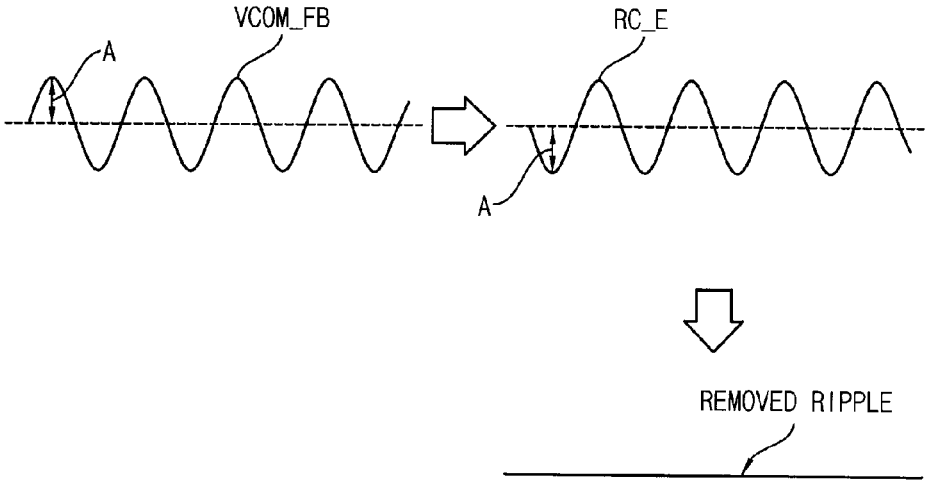
FIGS. 5A and 5B are conceptual diagrams illustrating an exemplary embodiment of a method of removing the ripple, according to the invention, and a comparative embodiment.
Figure 5B:
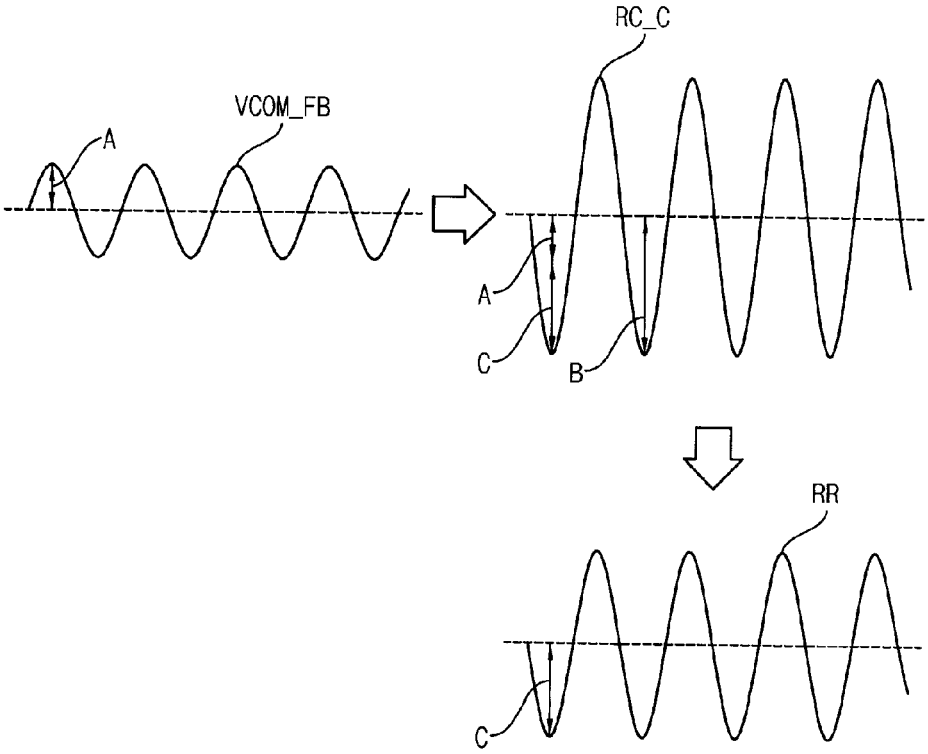

FIGS. 5A and 5B are conceptual diagrams illustrating an exemplary embodiment of a method of removing the ripple according to the invention and a comparative embodiment.

FIG. 5A is a conceptual diagram illustrating an exemplary embodiment of a method of removing the ripple according to the invention, and FIG. 5B is a conceptual diagram illustrating a conventional method of removing the ripple in a comparative embodiment.

Referring to FIG. 5A, a ripple signal VCOM_FB, which is received from the display panel 100, may have a first amplitude A. According to an exemplary embodiment, a comparing part generates a compensation ripple signal RC_E through an inverting amplifier which has a first gain value corresponding to the first amplitude A. In one exemplary embodiment, for example, the compensation ripple signal RC_C has the same amplitude as the first amplitude A by the inverting amplifier having the first gain value of '1'. In such an embodiment, the compensation ripple signal RC_C is applied to the display panel such that the ripple signal VCOM_FB_E is offset by the compensation ripple signal RC_C.

However, in the comparative embodiment shown in FIG. 5B, an inverting amplifier which has a second gain value of '5' amplifies the ripple signal VCOM_FB having the first amplitude A to generate a compensation ripple signal RC_C. The compensation ripple signal RC_C in the comparative embodiment has a second amplitude B greater than the first amplitude A. The compensation ripple signal RC_C having the second amplitude B offsets the ripple signal VCOM_FB having the first amplitude A. The second amplitude B is greater than the first amplitude A such that a third amplitude C that is a difference between the first and second amplitudes A and B is not offset. Thus, remaining ripple signal RR of the third amplitude C remains in the display panel. According to the comparative embodiment, the display quality is decreased by the remaining ripple signal RR.

According to exemplary embodiments of the invention, as described herein, the compensation ripple signal may be generated by the amplifier having the gain value corresponding to the level of the ripple signal such that the ripple signal may be effectively removed.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A circuit for compensating ripple, the circuit comprising:

a reference signal generating part configured to generate a plurality of reference signals having levels different from each other;

a comparing part configured to compare a level of a ripple signal with the levels of the reference signals to determine the level of the ripple signal;

a compensating signal generating part configured to generate a compensation ripple signal corresponding to the level of the ripple signal, wherein the compensation ripple signal has a phase opposite to the ripple signal; and a push-pull circuit configured to stabilize the compensation ripple signal, wherein the comparing part comprises a plurality of comparators, wherein each of the comparators compares two reference signals among the reference signals with the ripple signal, and determines whether the level of the ripple signal is between levels of the two reference signals, and the compensating signal generating part comprises a plurality of amplifiers, wherein the amplifiers receive output signals of the comparators, respectively, and the amplifiers have gain values different from each other.

2. The circuit of claim 1, wherein the compensating signal generating part generates the compensation ripple signal through an amplifier having a gain value corresponding to the level of the ripple signal among the amplifiers.

3. A method of driving a display panel, the method comprising:

determining a level of a ripple signal, which is received from the display panel, by comparing the level of the ripple signal with levels of a plurality of reference signals, wherein the levels of the reference signals are different from each other;

generating a compensation ripple signal corresponding to the level of the ripple signal, wherein the compensation ripple signal has a phase opposite to the ripple signal; and providing the display panel with the compensation ripple signal, wherein the determining the level of the ripple signal comprises determining whether the level of the ripple signal is between two different levels of the reference signals, and wherein the generating the compensation ripple signal comprises generating the compensation ripple signal through an amplifier having a gain value corresponding to the level of the ripple signal among a plurality of amplifiers, which has gain values different from each other.

4. The method of claim 3, wherein when the level of the ripple signal is low, the compensation ripple signal is generated through an amplifier having a low gain value among the amplifiers, and when the level of the ripple signal is high, the compensation ripple signal is generated through an amplifier having a high gain value among the amplifiers.

5. The method of claim 3, further comprising:

stabilizing the compensation ripple signal using a push-pull circuit.

6. The method of claim 3, wherein the display panel comprises:

a thin film transistor connected to a data line and a gate line;

a liquid crystal capacitor connected to the thin film transistor; and a storage capacitor connected to the liquid crystal capacitor and a common line, wherein the ripple signal is received from a common voltage terminal which is connected to the common line.

7. The method of claim 6, wherein the compensation ripple signal is loaded into the common voltage to be applied to the common voltage terminal.

8. A display apparatus comprising:

a display panel comprising:

a thin film transistor connected to a data line and a gate line;

a liquid crystal capacitor connected to the thin film transistor; and a storage capacitor connected to the liquid crystal capacitor and a common line;

a voltage generating part configured to generate a common voltage which is applied to the common line; and a ripple compensation part configured to determine a level of a ripple signal, which is received from the display panel, and to generate a compensation ripple signal corresponding to the level of the ripple signal, wherein the compensation ripple signal has a phase opposite to the ripple signal, and wherein the ripple compensation part comprises:

a reference signal generating part configured to generate a plurality of reference signals having levels different from each other;

a comparing part configured to compare the level of the ripple signal with the levels of the reference signals to determine the level of the ripple signal; and a compensating signal generating part configured to generate the compensation ripple signal corresponding to the level of the ripple signal, wherein the comparing part comprises a plurality of comparators, wherein each of the comparators compares two reference signals among the reference signals with the ripple signal and determines whether the level of the ripple signal is between levels of the two reference signals, and the compensating signal generating part comprises a plurality of amplifiers, wherein the amplifiers receives output signals of the comparators, respectively, and the amplifiers have gain values different from each other.

9. The display apparatus of claim 8, wherein the compensating signal generating part generates the compensation ripple signal through an amplifier having a gain value corresponding to the level of the ripple signal among the amplifiers.

10. The display apparatus of claim 8, wherein when the level of the ripple signal is low, the compensating signal generating part generates the compensation ripple signal through an amplifier having a low gain value among the amplifiers, and when the level of the ripple signal is high, the compensating signal generating part generates the compensation ripple signal through an amplifier having a high gain value among the amplifiers.

11. The display apparatus of claim 8, wherein the ripple compensation part further comprises:

a push-pull circuit configured to stabilize the compensation ripple signal outputted from the compensating signal generating part.

12. The display apparatus of claim 8, wherein the display panel further comprises a common voltage terminal connected to the common line, and the ripple signal is received from the common voltage terminal.

13. The display apparatus of claim 12, wherein the voltage generating part loads the compensation ripple signal into the common voltage to be applied to the common voltage terminal.

* * * * *